United States Patent [19]

Lindblom

[11] Patent Number: 5,058,359

[45] **Date of Patent: * Oct. 22, 1991**

[54] LIGHTWEIGHT OVERHEAD BEAM FOR PORTABLE DISPLAY STRUCTURE

[75] Inventor: Curtis H. Lindblom, Burnsville, Minn.

[73] Assignee: Skyline Displays, Inc., Burnsville, Minn.

[ * ] Notice: The portion of the term of this patent subsequent to Aug. 7, 2007 has been disclaimed.

[21] Appl. No.: 522,655

[22] Filed: May 14, 1990

Related U.S. Application Data

[63] Continuation-in-part of Ser. No. 309,417, Feb. 10, 1989, Pat. No. 4,945,706.

[51] Int. Cl.[5] ..... E04C 2/30

[52] U.S. Cl. ..... 52/731; 160/368.1; 211/105.1; 248/205.2

[58] Field of Search ..... 52/720, 731; 312/234.4; 160/368.1; 40/538, 539, 605, 610; 211/105.1; 248/205.2

[56] References Cited

U.S. PATENT DOCUMENTS

| | | | |
|---|---|---|---|
| 1,175,077 | 3/1916 | Peirce | 52/697 |
| 4,945,706 | 8/1990 | Beaullieu | 52/731 |

*Primary Examiner*—James L. Ridgill, Jr.

*Attorney, Agent, or Firm*—Paul L. Sjoquist; Robert J. Jacobson

[57] ABSTRACT

A lightweight portable one-piece beam for attachment to a portable display structure and including two triangular, elongate, tubular portions running along elongate edges of the beam for lending stability to the beam. The beam is convertible from its stable folded form with tubular portions to a flat, portable form.

18 Claims, 3 Drawing Sheets

LIGHTWEIGHT OVERHEAD BEAM FOR PORTABLE DISPLAY STRUCTURE

This application is a continuation-in-part of commonly assigned application Ser. No. 309,417, filed Feb. 10, 1989, and issued as U.S. Pat. No. 4,945,706, on Aug. 7, 1990, which is hereby incorporated by reference.

BACKGROUND OF THE INVENTION

The present invention relates generally to exhibit display systems, and more particularly to the field of portable display exhibits, of the type having a lightweight framework adapted for easy erection and disassembly.

The field of portable exhibit display structures has expanded rapidly in recent years, to meet the need for providing truly portable structures of lightweight material, which may be readily transported from place to place and quickly erected for display purposes. One such structure is disclosed in U.S. Pat. No. 4,658,560, issued Apr. 21, 1987, which is hereby incorporated by reference and wherein a portable frame consisting of lightweight triangulated struts is combined with a number of vertical channel members to form a structure for hanging sheets of plastic material to serve as a display surface. Although the frame structure itself is extremely lightweight and incapable of supporting significant vertical loading, the channel members do provide some vertical rigidity for supporting limited loading. After plastic panels are hung on this structure to form a display, it has the appearance of a curved wall and is suggestive of a solid wall construction, even though it actually has only limited supportive strength. The display structure may be used to support lights, shelving, and various types of hanging brackets, if the vertical loading is kept within predefined limits.

Another such portable display structure is disclosed in international patent application No. PCT/US87/02157, filed Aug. 26, 1987, which is hereby incorporated by reference and discloses a display frame comprised of interlocking members, and which may be readily assembled and disassembled. This display structure is adapted for hanging plastic panels over the frame members, and may be further adapted for the attachment of lights, shelving and other structural members.

Since portable display structures function is primarily to provide a pleasing visual perception, considerable effort is made to select display panel materials which will enhance this visual perception. The lighting and other materials associated with the display are also selected to enhance this perception, while at the same time all materials must be readily adaptable to ease of assembly and disassembly. For this reason the display panels are typically selected from plastic sheet material, frequently having a fabric covering, which may be readily rolled up for deposit in a storage container. The frame and channels are also adaptable for assembly and disassembly, and for storage in a portable container, so that the entire assembly may be easily transported from one location to another. It is therefore a desirable feature of structures of this type to have the appearance and rigidity and strength when in the erected form, while at the same time being adaptable for quick assembly and/or disassembly, and for easy storage into containers which may be transportable.

The parent commonly assigned patent application Ser. No. 309,417 entitled "Lightweight Overhead Beam for Portable Display Structure" discloses a beam formed of two pieces of elongate flexible material wherein one of the flexible pieces has a width dimension larger than the other flexible piece. Both pieces of material have an attachment device extending along their respective elongate edges to cause the wider piece to become bowed outwardly when attached to the narrower piece to lend stability to the beam.

One of the problems with the beam disclosed in patent application Ser. No. 309,417 is mounting the beam on flat structures. Because of its thickness dimension, the beam extends at a relatively great distance from the face of a flat display and may apply a relatively great leverage on the display and on the means connecting the beam to the display. Although it is possible to connect the beam to a flat display, the beam is preferably mounted on a curved display structure.

SUMMARY OF THE INVENTION

It is the principal object of the present invention to provide a lightweight beam construction having the appearance of strength and rigidity, from plastic sheet materials.

A feature of the present invention is the provision in a lightweight portable beam adapted for attachment to a frame for displaying graphics, of a header section of flexible material of elongate length stabilized by securing a tubular portion of elongate length to the rear face of the header section.

Another feature is the provision in such a lightweight portable beam, of a pair of tubular portions running along the elongate edges of the header section to further stabilize the beam.

Another feature is the provision in such a lightweight portable beam, of bendable sections of elongate length which are hingedly connected to the header section and which include elongate seams for folding the bendable sections into the tubular portions which provide the stability to the beam.

An advantage of the present invention is that it is readily attachable to flat portions of portable display frames.

Another advantage is that it has the appearance of strength, stability, and rigidity.

Another advantage is that it is lightweight and formed from plastic sheet materials.

Another advantage is that it possesses three-dimensional stability.

Another advantage is that it may be formed from translucent plastic sheet materials to permit backlighting for the display of graphic images printed on the beam.

DESCRIPTION OF THE DRAWINGS

The foregoing and other objects and advantages will become apparent from the following specification and claims, and with reference to the appended drawings, in which:

DESCRIPTION OF THE PREFERRED EMBODIMENT

Figure 1:
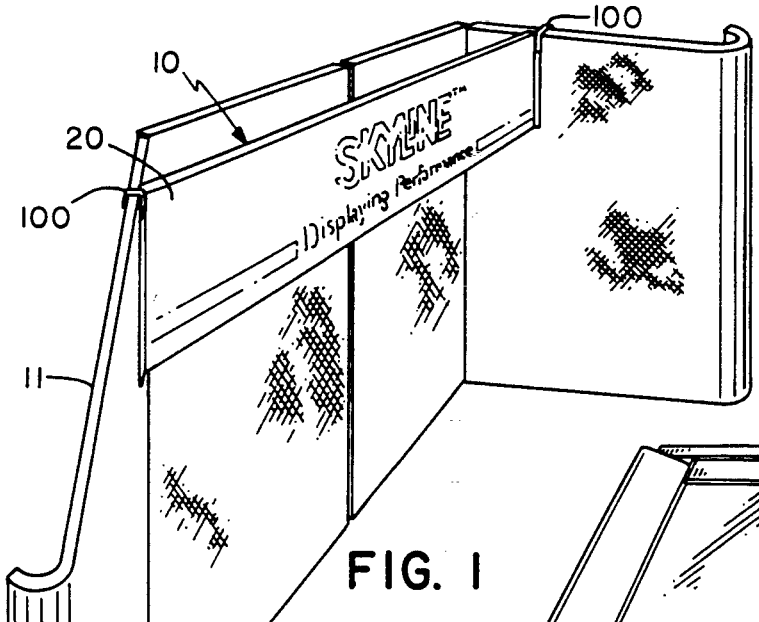
FIG. 1 is a perspective view of the beam attached to a display structure.

As shown in FIG. 1, the reference numeral 10 indicates in general a lightweight portable beam adapted for attachment to a display 11. The display 11 is a lightweight, portable, reconfigurable, multi-panel display structure and is merely an example of the type of display structure usable with the beam 10. The beam 10 is mountable on other frames such as the frames disclosed in U.S. Pat. No. 4,658,560 and the PCT Application No. PCT/US87/02157. The beam 10 is mountable on display frames with either flat or curved front display faces.

Figure 2:
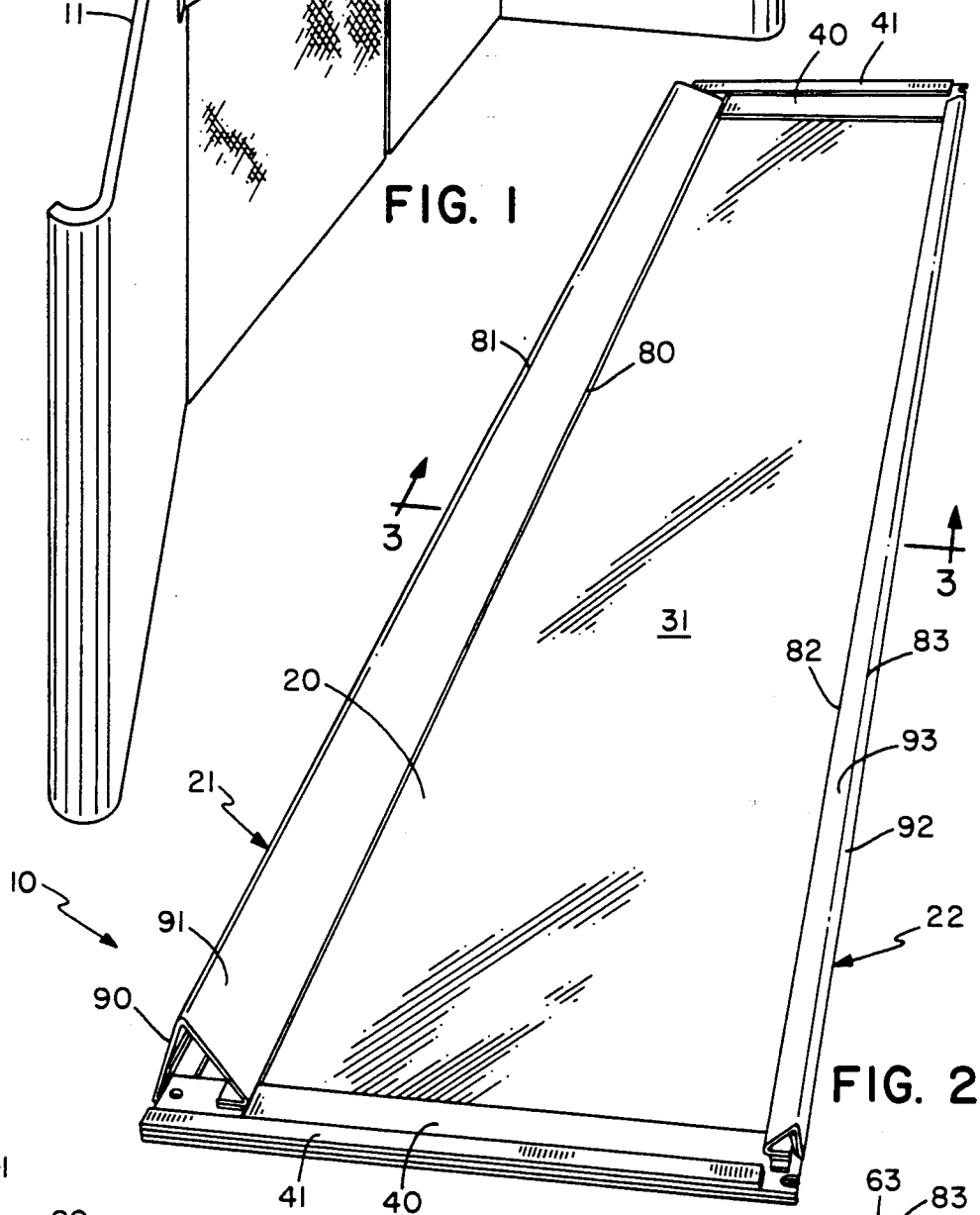
FIG 2 is a perspective view of the rear side of the beam of FIG. 1 in its folded form.
Figure 3:
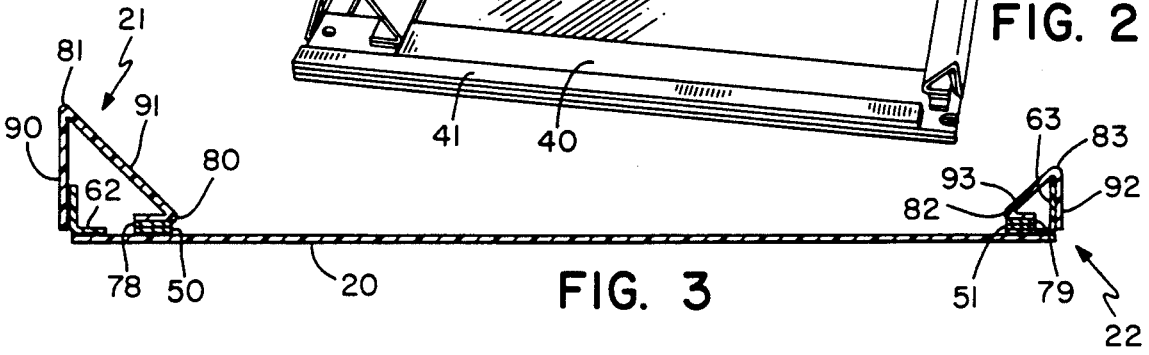
FIG. 3 is a cross-sectional view at lines 3—3 of FIG. 2.

As shown in FIGS. 2 and 3, the beam 10 includes as its principal components a header section 20 of flexible material of elongate length and a pair of triangular, elongate tube-like portions 21, 22 secured to the header section 20. The tubular portions 21, 22 lend stability, rigidity and strength to the header section 20 which typically includes printed graphic images or information.

Figure 4:
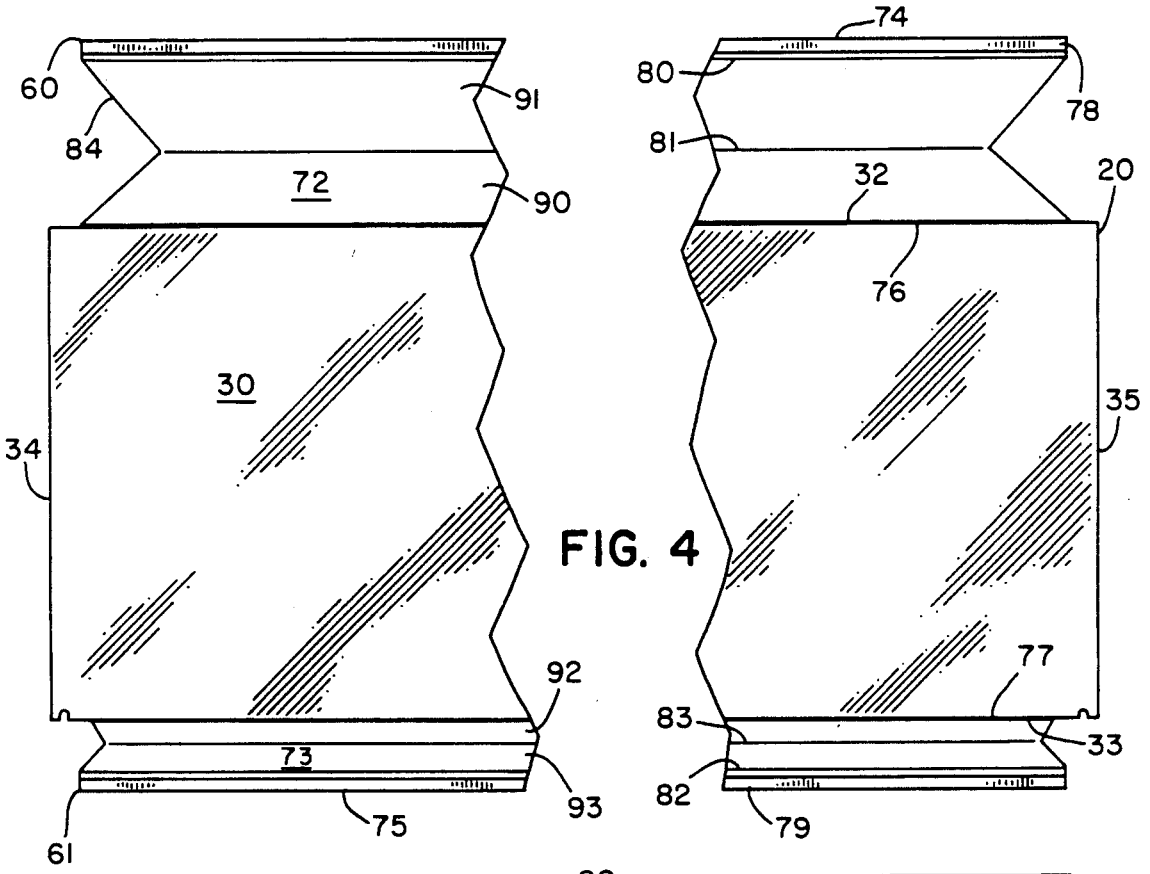
FIG. 4 is a front elevation view of the flat form of the beam of FIG. 1
Figure 5:
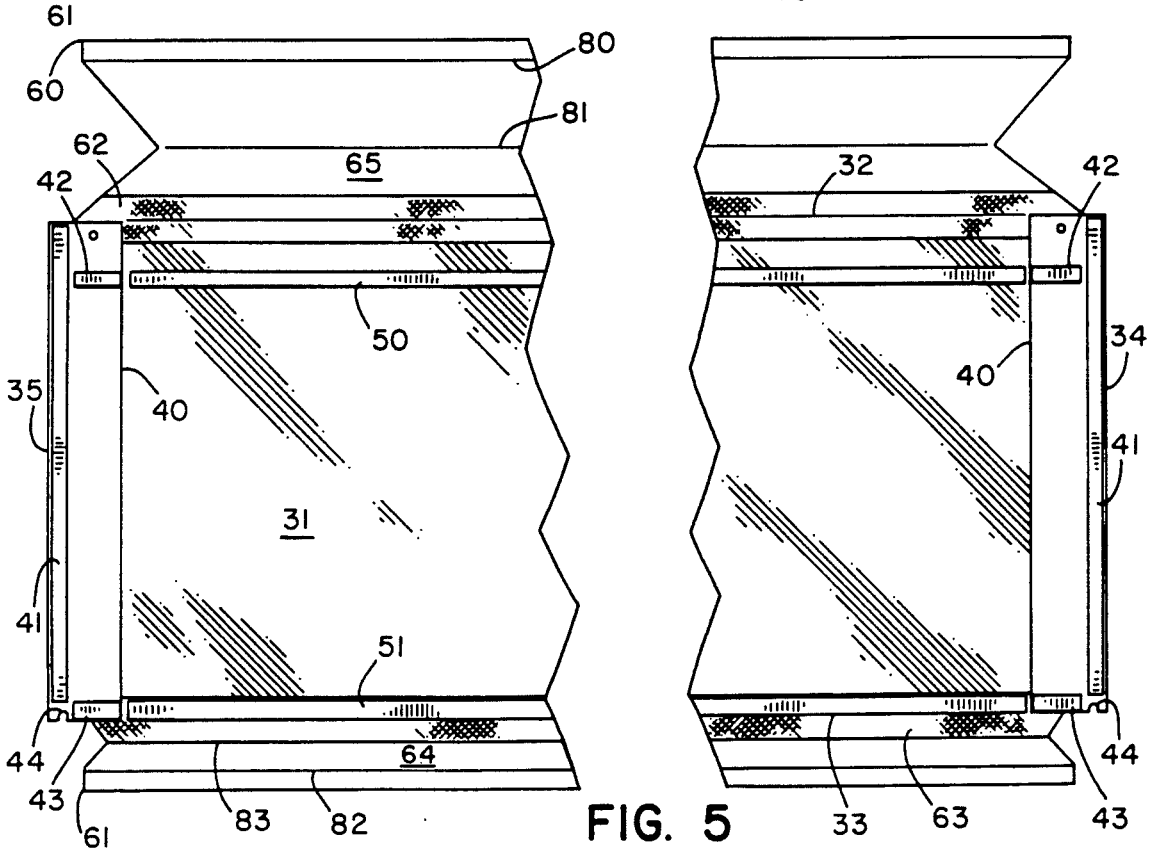
FIG. 5 is a rear elevation view of the flat form of the beam of FIG. 1.

As shown in FIGS. 4 and 5, the header section 20 is elongate, flat and rectangular and includes front and rear faces 30, 31, upper and lower elongate edges 32, 33, and outer end edges 34, 35. The header section 20 is typically formed of a translucent plastic sheet material such as polycarbonate.

The header section 20 includes a rigid metal or plastic plate 40. Each of the plates 40 is affixed such as by gluing on the rear face 31 of the header section 20 so as to be flush with elongate and end edges 32, 35. Each of the plates 40 includes an adhesive means or elongate magnetic strip 41 and a pair of upper and lower horizontal metallic strips 42, 43. The strips 41–43 are affixed to the rear face of the plate 40 such as by gluing. Each of the plates 40 further includes on its bottom edge a U-shaped pin-receiving indent 44 aligned with the magnetic strip 41.

The header section 20 further includes a pair of upper and lower, elongate, magnetic strips or adhesive means 50, 51. The strips 50, 51 are affixed such as by gluing to the rear face 31 of header section 20. Each of the strips 50, 51 runs parallel to each other and to each of the elongate edges 32, 33. Strips 50, 51 are aligned with and between respective metallic strips 42, 43 on opposing plates 40. Strip 50 is spaced from elongate edge 32 of header section 20. One edge of strip 51 lies substantially flush with edge 33 of header section 20.

Hingedly secured to elongate edges 32, 33 of the header section 20 is a pair of bendable sections 60, 61. Each of the bendable sections 60, 61 is secured to the respective elongate edges 32, 33 via respective upper and lower strips of heavy-duty tape or hinged connection means 62, 63 secured to respective rear faces 64, 65 of the bendable section 60, 61 and the rear face 31 of the header section 20.

Magnetic strip 51 is affixed on tape strip 63 and portions of plates 40 are affixed over end portions of the tape strips 62, 63. The bendable sections 60, 61 are typically formed of a polycarbonate material.

The bendable sections 60, 61 further include respective front faces 72, 73 and elongate, outer, free edges 74, 75 running parallel to elongate, inner, hinged edges 76, 77 which are affixed to the header section 20 via the tape strips 62, 63. The bendable sections 60, 61 include elongate magnetic strips or adhesive means 78, 79 running along edges 74, 75 and affixed to the front faces 72, 73. One edge of each of the magnetic strips 78, 79 runs flush with its respective edge 74, 75. Magnetic strip 78 lies parallel to and cooperates with magnetic strip 50 and metallic strip 42. Magnetic strip 79 lies parallel to and cooperates with magnetic strip 51 and metallic strip 43.

Bendable section 60 includes a pair of elongate seams 80, 81 and bendable section 61 includes a similar pair of elongate seams 82, 83. The seams 80–83 allow a folding of the sections 60, 61.

Seams 80–83 run parallel to each other and to the magnetic strips 50, 51 and 78, 79. Seams 81, 83 are disposed between the apexes of V-shaped indents 84 formed in end portions of the bendable sections 60, 61.

Bendable section 60 is foldable along the seams 80, 81 and hinge connection 62 such that the face of the magnetic strip 78 is securable to the faces of the metallic and magnetic strips 42, 50. When secured as such, tubular portion 21 is formed. Triangular tubular portion 21 includes planar side portions 90, 91 formed by bendable section 60 and a third planar side portion formed generally by the header section 20.

Bendable section 61 is foldable along the seams 82, 83 and hinged connection 63 such that the face of magnetic strip 79 is securable to the faces of metallic and magnetic strips 43, 51. When secured as such, tubular portion 22 is formed. Triangular tubular portion 22 includes planar side portions 92, 93 formed by bendable section 61 and a third planar side portion formed generally by the header section 20.

Bendable section 60 has a greater width dimension than bendable section 61 and hence tubular portion 21 has a greater periphery than tubular portion 22. The larger tubular portion 21 is typically disposed on the upper edge 32 of the header section 20 and may alone sufficiently stabilize and support the header section 20. However, in the preferred embodiment, both tubular portions 21, 22 are utilized.

Figure 6:
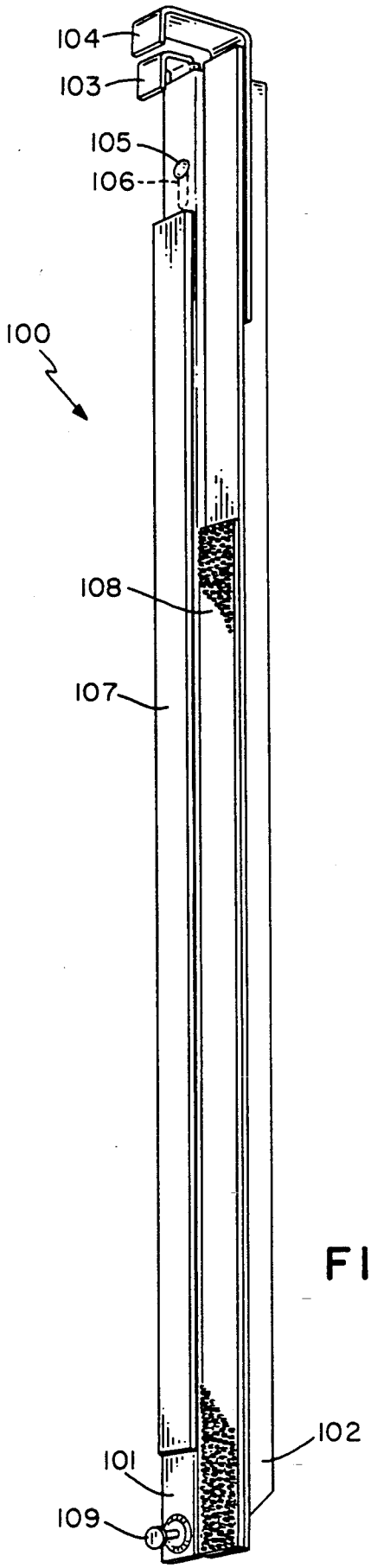
FIG. 6 is a perspective partially phantom view of a fastener for fastening the beam of FIG. 1 to a frame.

As shown in FIG. 6, a mechanical connection means 100 includes a rigid angle bar 101 and a flexible angled hinge 102 affixed back-to-back. An upper portion of the rigid angle bar 101 includes a vertically slidable hook portion 103 and an upper portion of the flexible angled hinge 102 includes a non-slidable flexible hook 104 of greater length than hook 103. The hook 103 slides on a headed pin 105 which extends from the angle bar 101 and through an elongate slot 106 which is formed in a rear bar portion of the hook 103. Rigid angle bar 101, typically formed of metal, further includes a vertical magnetic strip or adhesive means 107 for cooperating with magnetic strip 41 of the rigid plate 40 and flexible hinge 102 includes a vertical Velcro® hook-and-loop fastener strip or adhesive means 108 for cooperating with the fabric of the display 11. A bottom portion of rigid angle bar 101 includes a headed pin 109 for cooperating with the indent 44 of the plate 40. The mechanical connection means 100, along with the rigid plate 40 and its magnetic strip 41 and indent 44, form generally an attachment means for attaching the beam 10 to the display panel 11.

In its preferred form, the header section of the present invention should have a longitudinal dimension which is at least five times as great as its transverse dimension. It is preferable that the tubular portions 21, 22 be arranged with longitudinal fold lines such that the tubular portions may each adopt a triangular cross section, with the tubular portion 22 being of substantially smaller cross section than tubular portion 21. The material which is utilized for making tubular sections 21, 22 is preferably of greater thickness than the material used to make header section 20, although in its flattened form the entire assembly should be adapted for forming into a roll, for convenient rolled up storage.

In operation, the beam 10 may be stored in a rolled up form in a cylindrical case. The beam 10 may then be rolled out from its rolled up form to a flat form as shown in FIGS. 4–5. Subsequently, to create tubular portions 21, 22, the bendable sections 60, 61 are folded along seams 80–83 and hinged connections 62, 63. Each of the magnetic strips 78, 79 is then secured to its respective metal and magnetic strips 42, 43, 50, 51. When formed, the tubular portions 21, 22 lend strength, stability, and rigidity to the header section 20. To attach the beam 10 to the display panel 11, the mechanical connection means 100 is first affixed to the display 11, by attaching hook 104 over the panel and adhering adhesive means 108 to the panel fabric. Next, the headed pin 109 of the mechanical connection means 100 is slid into the indent 44 of the plate 40 and magnetic strips 107 and 41 brought together. The hooks 103 are then slidably hooked over a top edge of beam 10. When the beam 10 is disposed on the display panel 11, tubular portions 21, 22 may bear against the front face of display panel 11, or may be forward of the front face.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A lightweight portable beam adapted for attachment to a display panel, comprising:

a) a header section made from relatively thin flexible plastic material adapted for displaying graphics, said header section having a longitudinal dimension with respective elongate edges which is at least five times its transverse dimension with respective shorter edges;

b) means for attaching said header section to a display panel;

c) a first elongate edge section having means for edgewise attachment to one of said header section elongate edges, said first edge section having longitudinal fold lines and means for attachment to form a closed three-dimensional channel along one of said header section elongate edges; and d) a second elongate edge section having means for edgewise attachment to the other of said header section elongate edges, said second edge section having longitudinal fold lines and means for attachment to form a closed three-dimensional channel along the other of said header section elongate edges.

2. A lightweight portable beam adapted for attachment to a frame, comprising:

a) a header section of flexible material of elongate length with opposing, elongate edges, the header section being adaptable for displaying graphics;

b) attachment means on the header section for attaching the header section to the frame;

c) a pair of first and second foldable sections of flexible material of elongate length, each of the foldable sections having hinged and magnet-receiving elongate edges, the hinged edge of one of the foldable sections being hingedly connectable to one of the elongate edges of the header section and the hinged edge of the other foldable section being hingedly connectable to the other elongate edge of the header section, each of the bendable sections having an elongate magnetic strip running along its respective magnet-receiving edge, each of the bendable sections having at least two elongate seams, each of the foldable sections being foldable along the seams from a flat form to a folded form, and d) a pair of elongate magnetic strips on the header section for being magnetically connected to the magnetic strips of the bendable sections, one of the magnetic strips of the header section running along one of the elongate edges of the header section for cooperating with the magnetic strip of one of the foldable sections, the other magnetic strip of the header section being spaced from the other edge of the header section for cooperating with a magnetic strip of the other foldable section such that when the magnetic strips are connected the foldable sections are secured in their folded forms to create a pair of triangular tubular portions with the header section whereby the tubular portions lend stability to the header section.

3. A lightweight portable beam adapted for attachment to a display panel, comprising:

a) a header section of flexible material of elongate length with elongate edges, the header section being adaptable for displaying graphics;

b) means for attaching the header section to the display panel; and c) at least one bendable section of flexible material of elongate length with elongate edges, the bendable section being securable along an elongate edge of the header section, the bendable section being bendable from a flat form to a bent form.

4. The apparatus of claim 3, wherein the bendable section may be formed into a closed triangular shape and comprises at least three elongate planar sides, the bendable section forming two of the sides and the header section forming one of the sides.

5. The apparatus of claim 3, wherein at least a portion of the header section is translucent.

6. The apparatus of claim 3, wherein at least a portion of the header section is formed of a polycarbonate plastic.

7. The apparatus of claim 3, wherein the attachment means comprises a rigid plate affixed to each of the ends of the header section, and mechanical connection means connectable from each of the rigid plates to the display panel.

8. The apparatus of claim 3, wherein a pair of bendable sections are securable to the header section, each of the bendable sections being secured adjacent to one of the elongate edges of the header section such that a pair of bendable sections run along the edges of the header section.

9. The apparatus of claim 8, wherein one of the bendable sections has a greater width dimension than the other bendable section to form closed bendable sections of greater and smaller dimensions.

10. The apparatus of claim 3, wherein the bendable section includes at least one elongate seam, the bendable section being foldable along the seam to create the bent form and closed tubular shape.

11. The apparatus of claim 10, wherein the elongate seam comprises a first elongate adhesive strip affixed between one of the edges of the bendable section and an elongate edge of the header section.

12. A lightweight portable beam adapted for attachment to a display panel, comprising:

a) a header section of flexible material of elongate length with elongate edges, the header section being adaptable for displaying graphics;

b) means for attaching the header section to the display panel;

c) a first bendable section of flexible material of elongate length with elongate edges, one of the edges being hingedly connectable to one of the elongate edges of the header section, the bendable section being bendable from a flat form to a bent form, the sections lying in a common plane when the bendable section is disposed in the flat form; and d) a second bendable section of flexible material of elongate length with elongate edges, and of the edges being hingedly connectable to the other of the elongate edges of the header section such that a pair of bendable sections respectively run along the edges of the header section.

13. The apparatus of claim 12, wherein the bendable sections are formable into a triangular form comprising at least three elongate planar sides, each bendable section forming two of the sides and the header section forming one of the sides.

14. The apparatus of claim 12, wherein the respective bendable sections each include at least one elongate seam, the bendable section being foldable along the seam to create the bent form.

15. The apparatus of claim 12, wherein one of the bendable sections has a greater width dimension than the other bendable section to form two tubular portions of greater and smaller dimensions.

16. The apparatus of claim 3, wherein said first and second elongate edge sections and respective means for attachment cooperate to form respective closed three-dimensional channels having triangular cross sections.

17. The apparatus of claim 12, wherein the attachment means comprises a rigid plate affixed to each of the ends of the header section, and mechanical connection means extending from each of the rigid plates to the frame.

18. The apparatus of claim 17, wherein the mechanical connection means is affixed to the rigid plate adhesive strips on the rigid plate and mechanical connection means.

* * * * *